US011161013B2

(12) United States Patent
Klopman

(10) Patent No.: US 11,161,013 B2
(45) **Date of Patent: *Nov. 2, 2021**

(54) BALANCE TRAINING DEVICE

(71) Applicant: James E. Klopman, Birmingham, AL (US)

(72) Inventor: James E. Klopman, Birmingham, AL (US)

(73) Assignee: SLAQ TEC LLC, Birmingham, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/140,053

(22) Filed: Jan. 2, 2021

(65) Prior Publication Data

US 2021/0121742 A1 Apr. 29, 2021

Related U.S. Application Data

(63) Continuation of application No. 16/932,692, filed on Jul. 17, 2020.

(60) Provisional application No. 62/849,379, filed on May 17, 2019.

(51) Int. Cl.
*A63B 26/00* (2006.01)

(52) U.S. Cl.
CPC ..... *A63B 26/003* (2013.01)

(58) Field of Classification Search
CPC . A63B 262/003; A63B 21/00047; A63B 4/00; A63B 23/126; A63B 23/16; A63B 21/028
See application file for complete search history.

(56) References Cited

U.S. PATENT DOCUMENTS

| | | | |
|---|---|---|---|
| 1,545,437 | A | 7/1925 | Albert |
| 2,539,869 | A | 1/1951 | Sicklesteel |
| 3,423,852 | A | 1/1969 | Willfred |
| 3,570,847 | A | 3/1971 | Bowen |
| 3,806,116 | A | 4/1974 | Malmberg et al. |
| 4,253,661 | A | 3/1981 | Russell |
| 4,491,318 | A | 1/1985 | Francke |
| 4,601,469 | A | 7/1986 | Sasser, Jr. |
| 4,893,809 | A | 1/1990 | Blankenzee |
| 5,048,823 | A | 9/1991 | Bean |
| 5,469,740 | A | 11/1995 | French et al. |
| 5,584,787 | A | 12/1996 | Guidry |
| 5,613,690 | A | 3/1997 | McShane et al. |

(Continued)

FOREIGN PATENT DOCUMENTS

| | | | |
|---|---|---|---|
| CN | 104083175 | A | 10/2014 |
| CN | 104083175 | B | 5/2016 |

(Continued)

*Primary Examiner* — Jennifer Robertson
*Assistant Examiner* — Catrina A Letterman

(57) ABSTRACT

Balance training aids are disclosed. Example embodiments disclose a user placing all or part of their body weight on a top surface of a platform that is sitting atop an unstable base member and attempts to balance or complete a balance challenge. In example embodiments, the user places at least a portion of one foot atop the platform during the balance challenge. Adjustability features can be provided so as to provide a varying degree of adjustability to the unstable base member, and thus, provide a varying degree of balance challenges or levels of difficulty.

19 Claims, 8 Drawing Sheets

(56) References Cited

U.S. PATENT DOCUMENTS 5,643,154 A 7/1997 Awbrey et al.
5,656,000 A 8/1997 Russell
5,833,587 A 11/1998 Strong et al.
5,897,474 A 4/1999 Romero
6,389,883 B1 5/2002 Berme et al.
6,461,285 B1 10/2002 Theunissen et al.
6,551,225 B1 4/2003 Romero
6,652,432 B2 11/2003 Smith
6,702,726 B2 3/2004 Lin
6,705,977 B1 3/2004 Ziak
6,719,676 B1 4/2004 Hsu
6,790,166 B2 9/2004 Broudy
6,929,588 B2 8/2005 Hobson
6,942,487 B2 9/2005 Corbalis
6,945,920 B1 9/2005 Kemery et al.
7,004,886 B2 2/2006 Chen
D517,136 S 3/2006 Chen
7,074,166 B2 7/2006 Weitzman
7,147,593 B2 12/2006 Vittone
7,169,099 B1 1/2007 Kemery et al.
7,288,055 B2 10/2007 Blaum
7,335,172 B2 2/2008 Laserow
7,374,517 B2 5/2008 Lockett
7,488,282 B2 2/2009 Leavitt
7,566,291 B2 7/2009 Lickle
7,601,107 B2 10/2009 Maloy
7,632,218 B2 12/2009 Sannes
7,645,221 B1 1/2010 Curry
7,717,379 B2 5/2010 Kimmel
7,806,807 B2 10/2010 Genua
7,811,216 B2 10/2010 Babiarz
7,833,144 B1 11/2010 Como et al.
7,922,624 B1 4/2011 Fairhurst et al.
7,931,570 B2 4/2011 Hoffman
7,946,928 B2 5/2011 Mooney
8,105,218 B1 1/2012 Vayntraub
8,105,220 B2 1/2012 Schultheisz
8,434,824 B2 5/2013 Spinabella et al.
8,517,853 B2 8/2013 Miller et al.
8,632,440 B2 1/2014 Pratson et al.
8,647,239 B1 2/2014 Sokolovas et al.
8,678,985 B2 3/2014 Mattox
8,900,165 B2 12/2014 Jeka et al.
D724,162 S 3/2015 James
8,998,319 B2 4/2015 Bahneman et al.
8,998,784 B1 4/2015 Sloan et al.
9,095,738 B2 8/2015 Senegal
D740,378 S * 10/2015 Walsh-Gomez ..... D21/662
9,295,911 B2 3/2016 Claudel et al.
9,320,940 B2 4/2016 Rainey
9,387,363 B1 7/2016 Polinsky
9,446,307 B2 9/2016 Klein et al.
9,457,226 B2 10/2016 Heath
9,545,533 B2 1/2017 Boyer
9,596,936 B2 3/2017 Bahneman et al.
9,630,040 B1 4/2017 Louis
9,744,402 B2 8/2017 Klassen
9,750,980 B1 9/2017 Khalili
9,913,508 B2 3/2018 Tzeng
D815,700 S * 4/2018 Brodwick ..... D21/686
9,931,540 B1 4/2018 Lazar et al.
9,999,807 B2 6/2018 Rainey
D823,404 S * 7/2018 Razon ..... D21/688
10,029,145 B2 7/2018 Douglass
10,045,647 B2 8/2018 Publicover et al.
10,071,287 B2 9/2018 Dedvukaj et al.
10,159,372 B2 12/2018 Heath
10,220,243 B2 3/2019 Koegel
10,252,103 B2 4/2019 Irwin et al.
10,456,626 B2 10/2019 Groshek
10,507,359 B1 12/2019 Shubin Stein
10,512,814 B1 12/2019 Conroy
10,674,786 B2 6/2020 Adair et al.
10,751,560 B2 8/2020 Hall
10,751,594 B2 8/2020 Lee
10,894,183 B2 1/2021 Irwin et al.
10,905,915 B2 2/2021 Wallace
2004/0018924 A1 1/2004 Szydlowski et al.
2004/0082399 A1 4/2004 Shioda
2004/0087421 A1 5/2004 Lin
2004/0198573 A1 10/2004 Brydson et al.
2005/0020418 A1 1/2005 William
2005/0049123 A1 3/2005 Dalebout et al.
2005/0148434 A1 7/2005 Stec
2005/0245372 A1 11/2005 Mylrea et al.
2006/0014615 A1 1/2006 Godbold
2006/0035771 A1 2/2006 Gant
2006/0040796 A1* 2/2006 Holloway ..... A63B 21/028 482/52
2006/0211553 A1 9/2006 Cantor
2007/0087902 A1 4/2007 Penat
2007/0155495 A1 7/2007 Goo
2007/0207901 A1* 9/2007 Traub ..... A63B 26/003 482/52
2007/0219076 A1* 9/2007 Axelrod ..... A63B 21/00047 482/148
2007/0298947 A1 12/2007 Eksteen
2008/0020856 A1 1/2008 Rosa
2008/0039304 A1 2/2008 Mattox
2008/0312043 A1 12/2008 Cook
2009/0178596 A1 7/2009 Skiba
2009/0215596 A1 8/2009 Obermaier
2009/0270231 A1 10/2009 Hall et al.
2009/0312165 A1 12/2009 Rempe
2010/0167887 A1 7/2010 Berry
2010/0279833 A1 11/2010 Gant
2010/0331154 A1 12/2010 Taylor
2011/0224059 A1 9/2011 Crawley
2011/0237412 A1 9/2011 Signorile
2012/0138113 A1 6/2012 Spinabella et al.
2012/0208678 A1 8/2012 Knilans
2012/0252644 A1 10/2012 Reade
2012/0258841 A1* 10/2012 James ..... A63B 21/00047 482/91
2013/0029814 A1 1/2013 D'Alessandro
2013/0047461 A1 2/2013 Tzeng
2013/0178346 A1* 7/2013 Lin ..... A63B 22/16 482/146
2013/0184131 A1 7/2013 Doyle
2013/0252217 A1 9/2013 Grzesiak et al.
2013/0267390 A1 10/2013 Warren
2013/0274078 A1* 10/2013 Andrews ..... A63B 21/4035 482/141
2013/0288866 A1 10/2013 Rainey
2013/0316886 A1 11/2013 Lynch et al.
2013/0334846 A1 12/2013 Bahneman et al.
2014/0011649 A1 1/2014 Carney
2014/0057758 A1 2/2014 Mack
2014/0081177 A1 3/2014 Eguibar et al.
2014/0162858 A1 6/2014 Dalebout
2014/0171213 A1 6/2014 Newman et al.
2014/0302973 A1 10/2014 Fitterer
2014/0329653 A1* 11/2014 Klopman ..... A63B 26/003 482/143
2014/0371041 A1 12/2014 Terpstra et al.
2015/0057138 A1 2/2015 Knilans
2015/0202495 A1 7/2015 Klein et al.
2015/0238820 A1* 8/2015 Langer ..... B32B 7/08 482/142
2015/0265878 A1 9/2015 Hjelt et al.
2015/0321051 A1 11/2015 Olson
2017/0072259 A1* 3/2017 Trenkle ..... A63B 21/4034
2017/0144017 A1 5/2017 Crist
2017/0172331 A1 6/2017 Publicover et al.
2017/0291069 A1 10/2017 Zakariasen
2018/0215434 A1 8/2018 Chen
2019/0008302 A1 1/2019 Publicover
2019/0070459 A1* 3/2019 Michaud ..... A63B 21/00047
2019/0076718 A1 3/2019 Lee
2019/0269973 A1 9/2019 Kopke et al.
2019/0282850 A1* 9/2019 Chen ..... A63B 21/4019

(56) References Cited

U.S. PATENT DOCUMENTS

| | | | |
|---|---|---|---|
| 2019/0282878 | A1 | 9/2019 | Gouzenko |
| 2020/0138662 | A1 | 5/2020 | Powell |
| 2020/0278757 | A1 | 9/2020 | Nir |

FOREIGN PATENT DOCUMENTS

| | | | |
|---|---|---|---|
| EP | 0210253 | A1 | 2/1987 |
| EP | 0464280 | A1 | 1/1992 |
| EP | 1166718 | B1 | 12/2004 |

* cited by examiner

BALANCE TRAINING DEVICE

CROSS-REFERENCE TO RELATED APPLICATION

This application is a continuation of U.S. Non-Provisional patent application Ser. No. 16/932,692 filed Jul. 17, 2020, which claims priority to U.S. Provisional Patent Application Ser. No. 62/849,379 filed May 17, 2019, the entirety of which is hereby incorporated herein by reference for all purposes.

TECHNICAL FIELD

The present invention relates generally to the field of athletic equipment and training, and more particularly to balance training aids and devices.

SUMMARY OF INVENTION

Example embodiments of the present invention relate to a balance training aid including a base member and a standing platform. According to one aspect, the invention relates to a balance device including a lower base component and an upper standing platform configured for placement atop the lower base component. In example embodiments, the lower base component is an unstable or deformable material and the platform is a generally rigid material. In example embodiments, the lower base component includes one or more adjustability features including reinsertable plugs that are initially integrally formed with the lower base component, disengagable therefrom by user operation or manipulation thereof, and reinsertable within the openings defined by the removal of the plugs so as to provide adjustment to the unstableness (instability) of the lower base component when a user is applying their weight thereon, for example by applying at least a portion of their foot atop the standing platform.

In one aspect, the present invention relates to a balance training aid including an upper standing platform and a lower base component, the upper standing platform configured for placement atop the lower base component and configured to receive at least a portion of a user's foot thereon, the lower base component being generally elongate and extending between first and second ends and including a top portion defining an upper surface and a bottom portion defining a lower surface, wherein the first and second ends of the lower base component includes a polygonal cross-sectional shape defining the upper and lower surfaces, and a pair of stability surfaces defined between the upper and lower surfaces thereof.

In example embodiments, the stability surfaces define an angle of between about 12-35 degrees relative to a vertical axis. In example embodiments, the polygonal cross-sectional shape is trapezoidal. In example embodiments, the lower base component includes at least one adjustability feature for providing variability to the unstableness of the balance training aid. In example embodiments, the at least one adjustability feature comprises a removable and reinsertable plug member. In example embodiments, the lower base includes two or more removable and reinsertable plug members. In example embodiments, the plug member is generally elongate defining a length and being generally cylindrical in cross section, and wherein one or more outwardly-extending protrusions extend from an outer periphery of the plug member along at least a portion of its length. In example embodiments, the platform comprises a length of between about 8-20 inches, a width of between about 3-6 inches, and a thickness of between about 0.25-0.75. In example embodiments, the lower base component defines a length of between about 8-20 inches between the first and second ends thereof, a height of between about 1.5-5 inches defined between the upper and lower surfaces, a first width of between about 3.5-7 inches defined at the lower surface and a second width of between about 2-5 inches defined at the upper surface. In example embodiments, the length is between about 12.50-14.88 inches, the height is between about 2.5-3.5 inches, the first width is between about 4.69-5.50 inches, and the second width is between about 3-3.5 inches. In example embodiments, the lower surface defines an I-shaped footprint, the I-shaped footprint defining an outer profile including a centrally-located narrowed portion and outwardly-located widened portions, the centrally-located narrowed portion comprising a central side-to-side dimension substantially similar to the second width, and wherein the outwardly-located widened portions define an outer side-to-side dimension that is substantially similar to the first width. In example embodiments, the lower base component comprises a foam material comprising cross-linked polyethylene, ethylene-vinyl acetate, or a combination thereof.

In another aspect, the present invention relates to a balance training device including an upper standing platform and a base member, the base member comprising a unitary, one-piece component having adjustability features to provide variability to the allowable deformation thereof between a most stable configuration with the least amount of allowable deformation and a most unstable configuration with the most amount of allowable deformation.

In example embodiments, each adjustability feature includes a generally elongate plug member fitted within a channel that is defined in the base member, the plug member being initially integral with the base member, the plug member being removable from the channel of the base member, and the plug member being reinsertable within the channel of the base member. In example embodiments, the base member defines a length, a height, an upper surface and opposite lower surface. In example embodiments, the lower surface defines a footprint and is configured for resting atop a surface, the footprint defining a polygonal shape. In example embodiments, the lower surface defines a footprint and is configured for resting atop a surface, the footprint being generally I-shaped defining an outer profile having a centrally-located narrowed portion and outwardly-located widened portions. In example embodiments, wherein the base member includes a polygonal cross-sectional shape when taken along its length.

In yet another aspect, the present invention relates to a balance device including a lower base component and an upper standing platform, the upper standing platform being configured for placement atop the lower base component, the lower base being an unstable or deformable material and the platform being a generally rigid material, the lower base component defining a length, a height, an upper surface and a lower surface, the lower surface defining a footprint having a centrally-located narrowed portion and outwardly-located widened portions.

DETAILED DESCRIPTION OF EXAMPLE EMBODIMENTS

Figure 1:
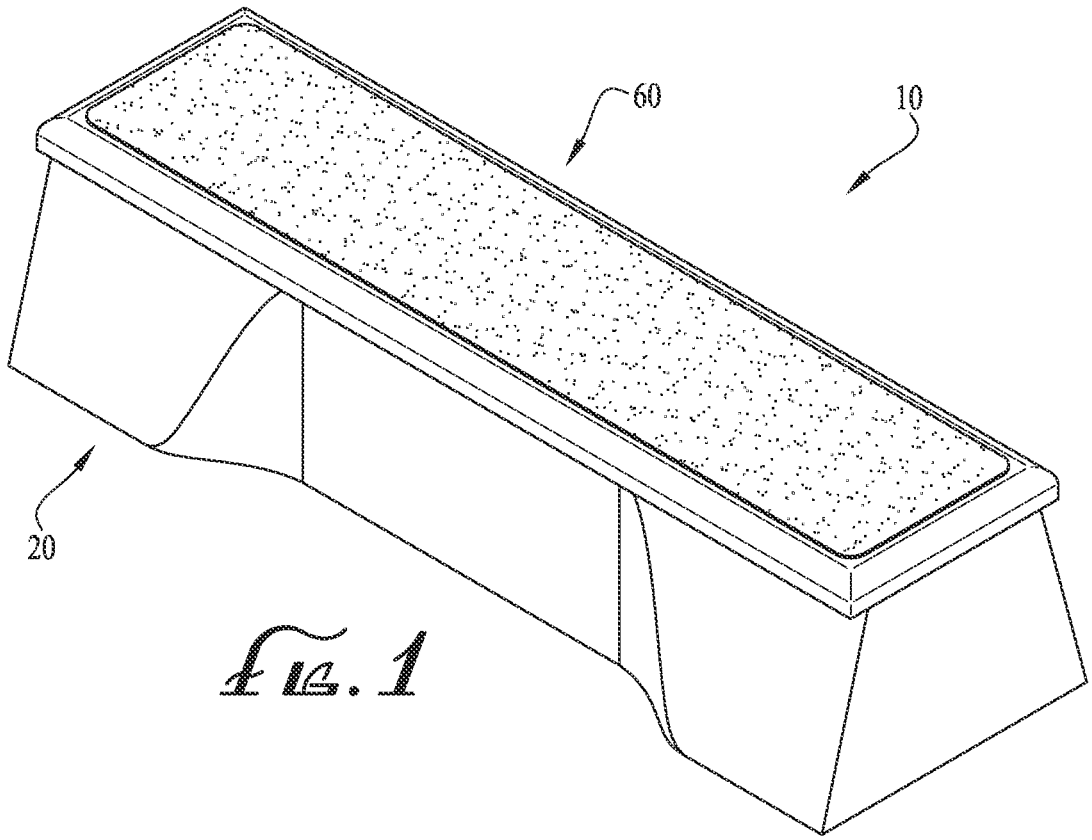
FIG. 1 is a front perspective view of a balance training device according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Example embodiments of the present invention relate to balance training devices that are generally configured for the placement of at least a portion of one foot of a user, athlete and/or other human or animal subject on a portion thereof, for example, such that the subject places all or part of their body weight on a top surface of a platform that is sitting atop a base member and attempts to balance. As will be described in greater detail below, the balance training devices as described herein generally comprise a base member and a standing platform. In example embodiments, the balance training devices are unstable and preferably the degree of stability thereof is adjustable between a most stable configuration and a most unstable configuration, or for example, a least unstable configuration and a least stable configuration.

With reference now to the drawing figures, wherein like reference numbers represent corresponding parts throughout the several views, FIGS. 1-12 show balance training devices according to example embodiments of the present invention. As depicted in FIGS. 1-5, the balance training device 10 generally comprises a base member 20 and an upper plate or platform 60. In example embodiments, the balance training device 10 is configured such that a user places one foot atop the platform 60 and attempts to balance thereon while their other foot remains free from engagement with the platform 60 or a ground surface that is supporting the base member 20 (see FIG. 12). In example embodiments, the balance training device 10 is unstable in a variety of directions, for example an axial direction, a transverse direction, and a vertical direction. Preferably, as will be described below, the degree of stability of the balance training device 10 is adjustable so as to affect the level of difficulty of the balance challenge a user is subjected to as they attempt to balance thereon.

Figure 2:
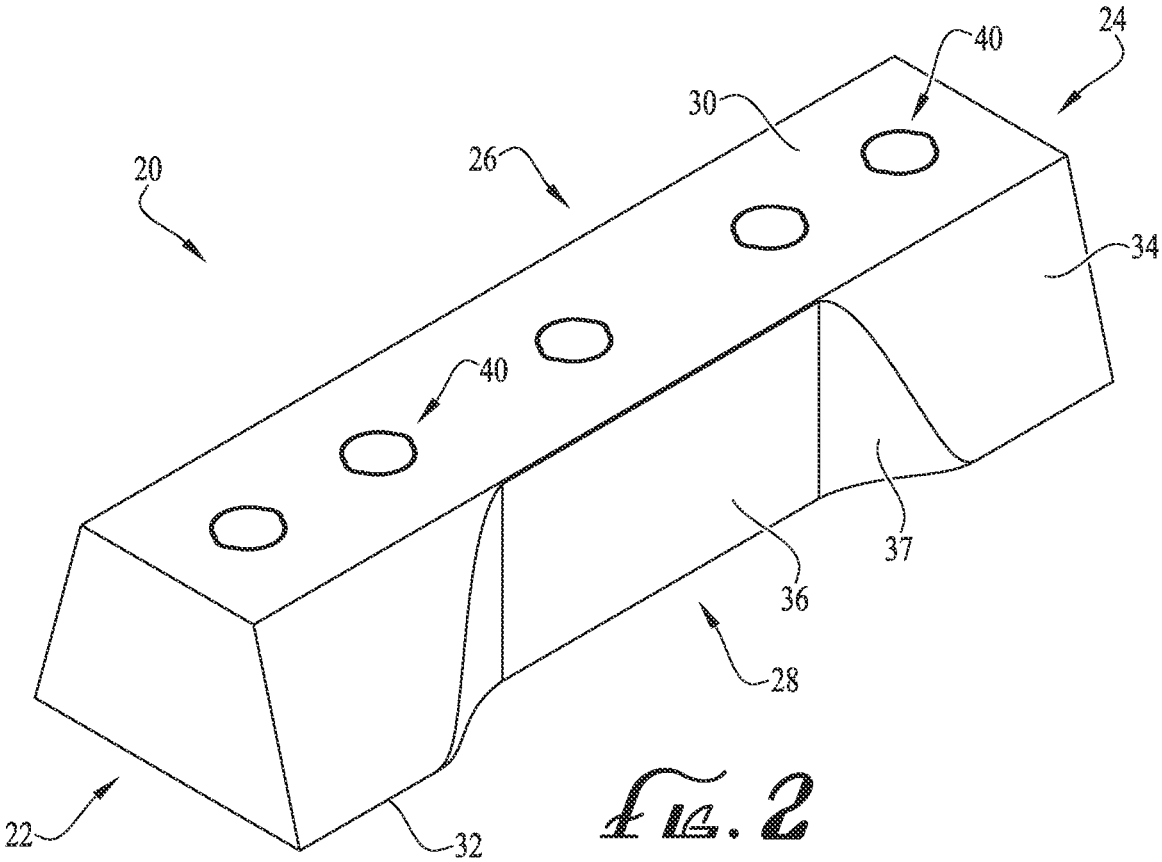
FIG. 2 is a front perspective view of a base member or component of the balance training device of FIG. 1.

Referring to FIG. 2, the base member 20 is generally elongate and extends from a first end 22 to a second end 24 and comprises a top portion 26 comprising an upper surface 30 and a bottom portion 28 comprising a lower surface 32. According to example embodiments, one or more adjustability features 40 can be provided/formed with the base member 20, for example, so as to provide adjustability to the base member 20 (as will be described in greater detail below).

Figure 3:
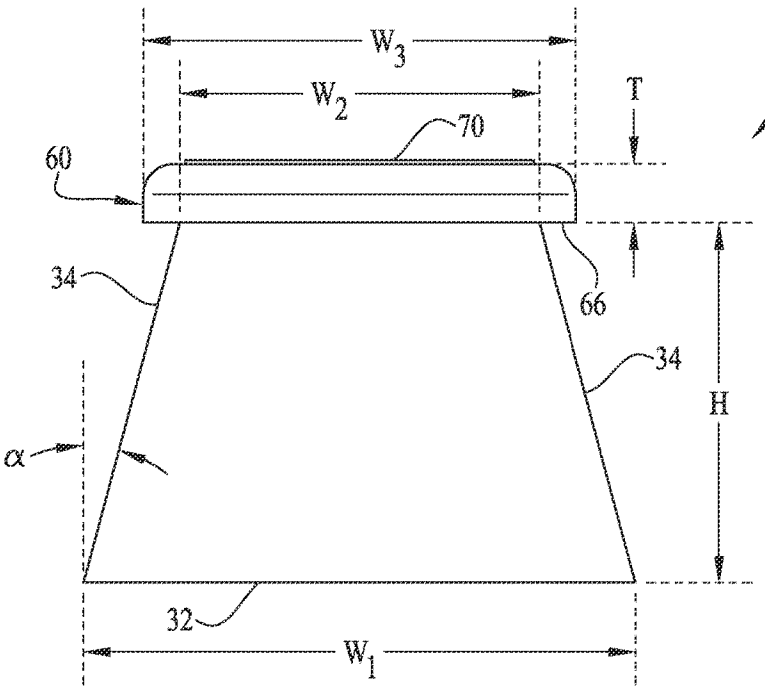
FIG. 3 is an end view of the balance training device of FIG. 1.
Figure 4:
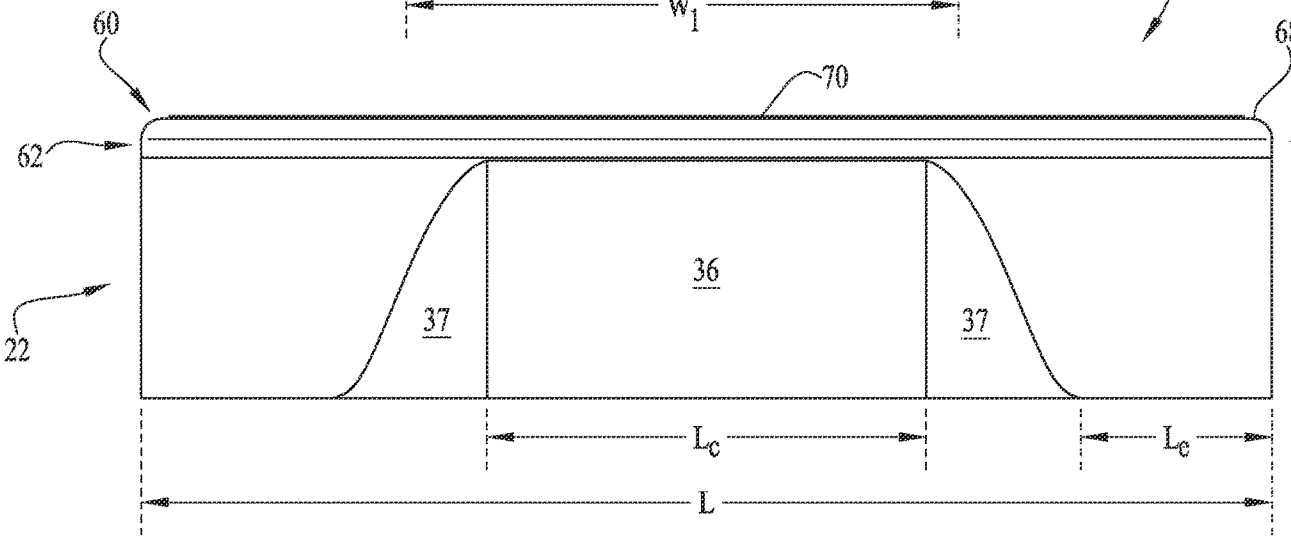
FIG. 4 is a side view of the balance training device of FIG. 1.

As depicted in FIGS. 3-4, the base member 20 comprises a length L, a width W1 defined at the bottom portion 28, a width W2 defined at the top portion 26, and a height H. According to example embodiments, the length L is generally between about 8-20 inches, for example, between about 11-18 inches according to some example embodiments. The width W1 is generally between about 3.5-7 inches, for example, between about 4.5-6 inches according to some example embodiments. The width W2 is generally between about 2-5 inches, for example, between about 3-4 inches according to example embodiments of the present invention. The height H is generally between about 1.5-5 inches, for example, between about 2.5-3.5 inches according to some example embodiments. According to one preferred embodiment, the length L is between about 12.88-14.88 inches, the width W1 is between about 4.69-5.50 inches, the width W2 is between about 3-3.5 inches, and the height H is between about 2.75-3.25 inches. Optionally, the base member 20 can be sized as desired. According to one alternate example embodiment, the dimensions as noted herein can be varied as desired, for example, up to about 70% less than the minimum values about 70% greater than the maximum values of the dimensional ranges as described herein.

According to example embodiments, the base member 20 comprises side surfaces defined along the length L thereof, for example, outer stability surfaces 34, central surfaces 36, and transitional surfaces 37 extending between the outer stability surfaces 34 and the central surfaces 36. According to example embodiments, the surfaces 34, 36, 37 are provided on both sides of the base member 20, for example, wherein the surfaces 34, 36, 37 are generally symmetrical and mirrored about an elongate axis extending along the length L of the base member 20 at its midpoint (see FIG. 5). Thus, according to example embodiments, the outer profile of the bottom portion 28 of the base member 20 defines a centrally-located narrowed portion and outwardly-located widened portions, for example, wherein transitions are defined between the narrowed portion and the widened portions. Preferably, the combination of the narrowed portion and the widened portions provides sufficient stability to the base member 20 (e.g., preventing the same from unintentionally rolling over, especially when a user is attempting to balance thereon) while also lessening stability at its center so as to provide enough instability to provide a sufficient balance challenge. According to one example embodiment, the lower surface of the bottom portion of the base member 20 comprises an I-shaped footprint, the I-shaped footprint defining an outer profile comprising a centrally-located narrowed portion and outwardly-located widened portions, the centrally-located narrowed portion comprising a central side-to-side dimension substantially similar to the second width W2, and wherein the outwardly-located widened portions define an outer side-to-side dimension that is substantially similar to the first width W1.

Figure 5:
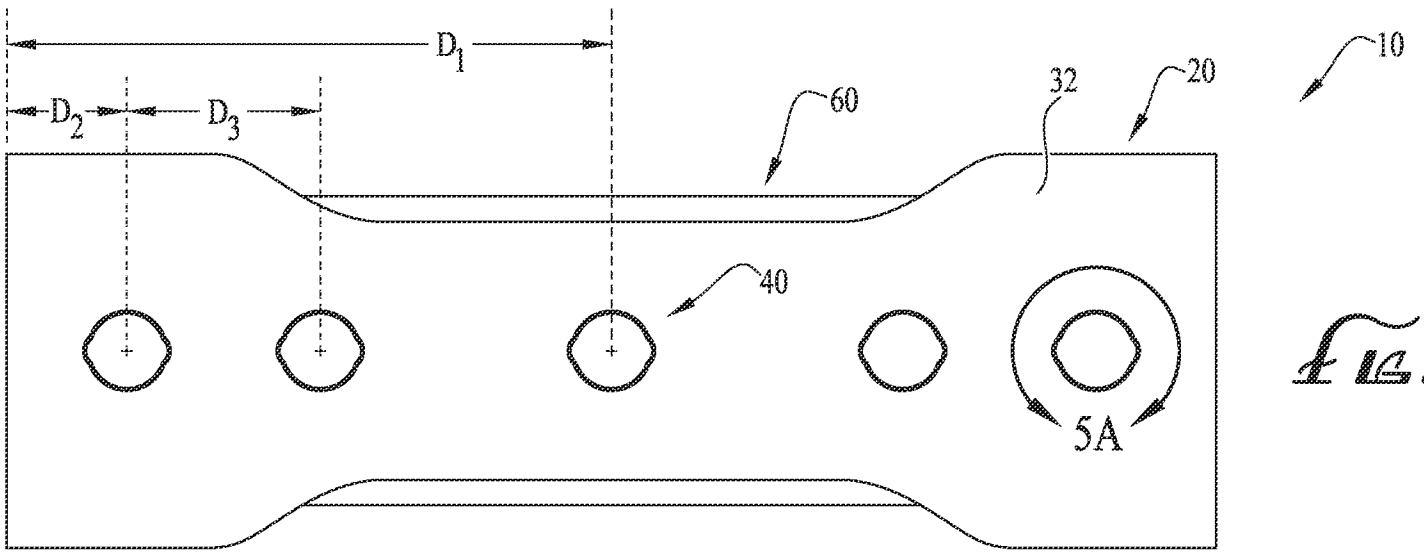
FIG. 5 is a bottom view of the balance training device of FIG. 1.
Figure 6:
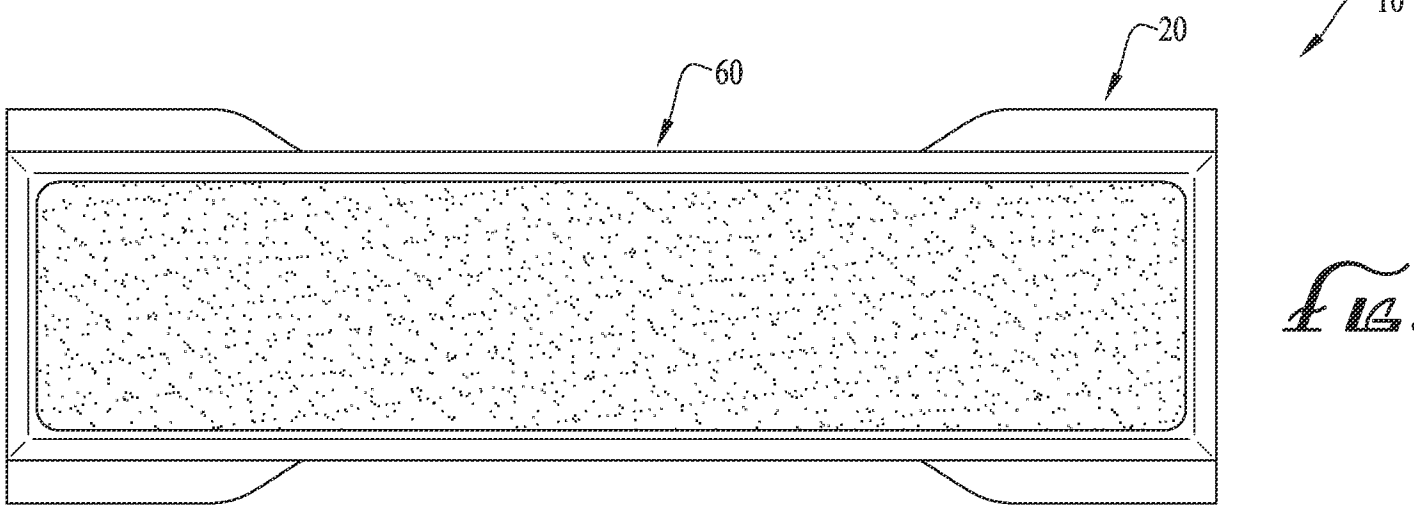
FIG. 6 is a top view of the balance training device of FIG. 1.

In example embodiments, the outer stability surfaces 34 are generally angled to define an angle $\alpha$ relative to a vertical axis, for example, wherein the angle $\alpha$ is generally between about 10-45 degrees, for example between about 12-35 degrees according to some example embodiments. The central surfaces 36 are generally substantially vertical, for example, such that the width of the bottom portion 28 at the base member's 20 center or midpoint is generally equivalent to the width W2 of the top portion 26. Thus, in example embodiments, the width defined along the entirety of the central portion of the base member 20 (e.g., proximal the central surfaces 36) is substantially uniform. As shown in FIG. 5, the transitional surfaces 37 provide a generally continuous transition from the central surfaces to the outer stability surfaces 34. According to example embodiments, the transitional surfaces 37 are generally curved or radiused so as to provide a smooth and gradual transition from the central surfaces 36 to the outer stability surfaces 34.

Referring to FIG. 4, the length or extension Lc of the central surfaces 36 is generally between about 4-7 inches, for example between about 4.5-6 inches according to some example embodiments. And the length or extension Le of the outer stability surfaces 34 is between about 1.5-3.5 inches, for example, between about 2-3 inches according to some example embodiments. Thus, according to example embodiments, the length of the transitional surfaces 37 is between about 1.25-2.25 inches, for example, between about 1.5-2 inches according to some example embodiments. Optionally, according to other example embodiments, the lengths Lc, Le and/or the length of the transitional surfaces can be chosen as desired.

According to some example embodiments of the present invention, the cross-sectional shape of the base member 20 preferably varies along its length. For example, with reference to FIGS. 3-5, a cross-section taken generally near the ends 22, 24 of the base member 20 and proximal the outer stability surfaces 37 defines a trapezoidal-like shape, and a cross-section taken at a central portion or midpoint of the base member 20 and proximal the central surfaces 36 defines a square or rectangular-like shape. In other example embodiments, the cross-section of the base member 20 along the length thereof can preferably be chosen as desired.

Figure 5A:
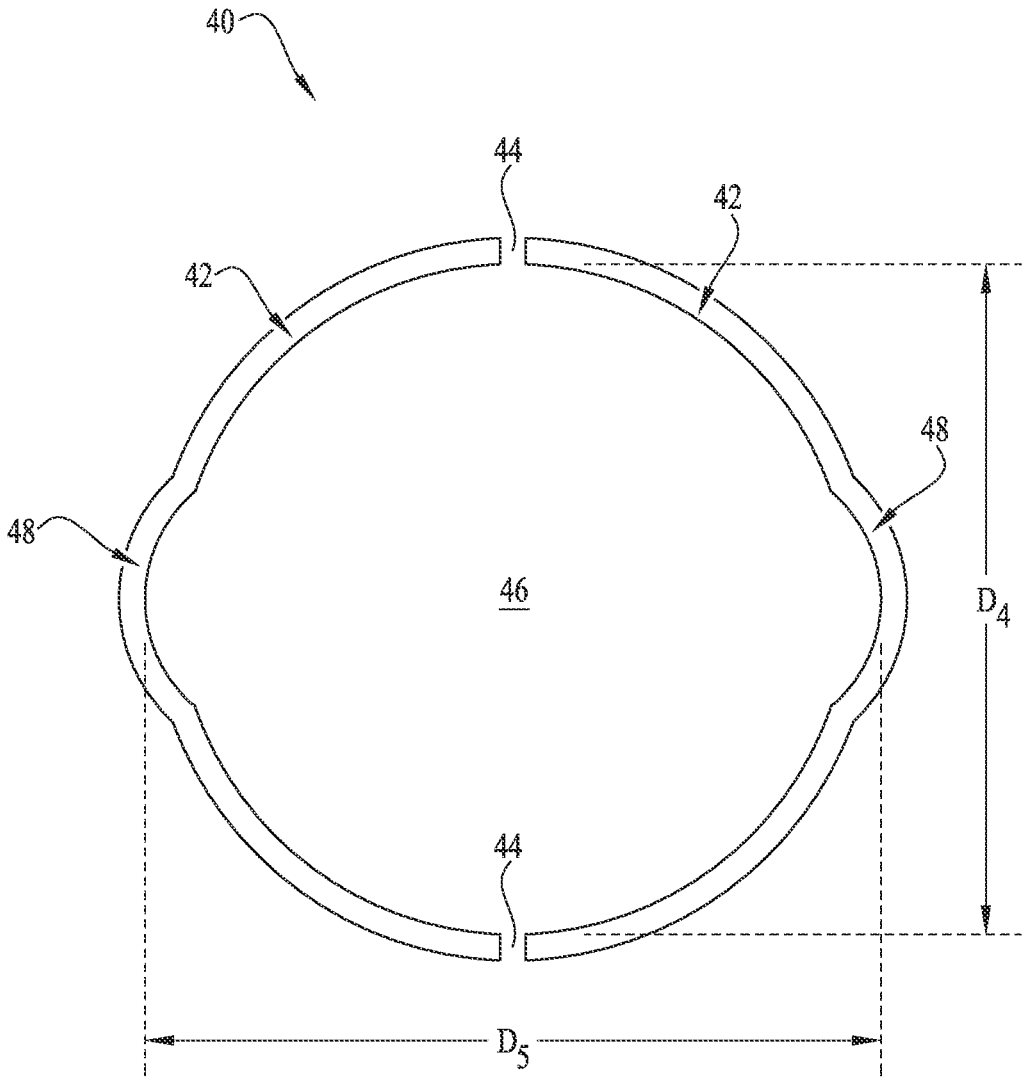
FIG. 5A is a detailed view of a portion of the balance training device of FIG. 5.
Figure 7:
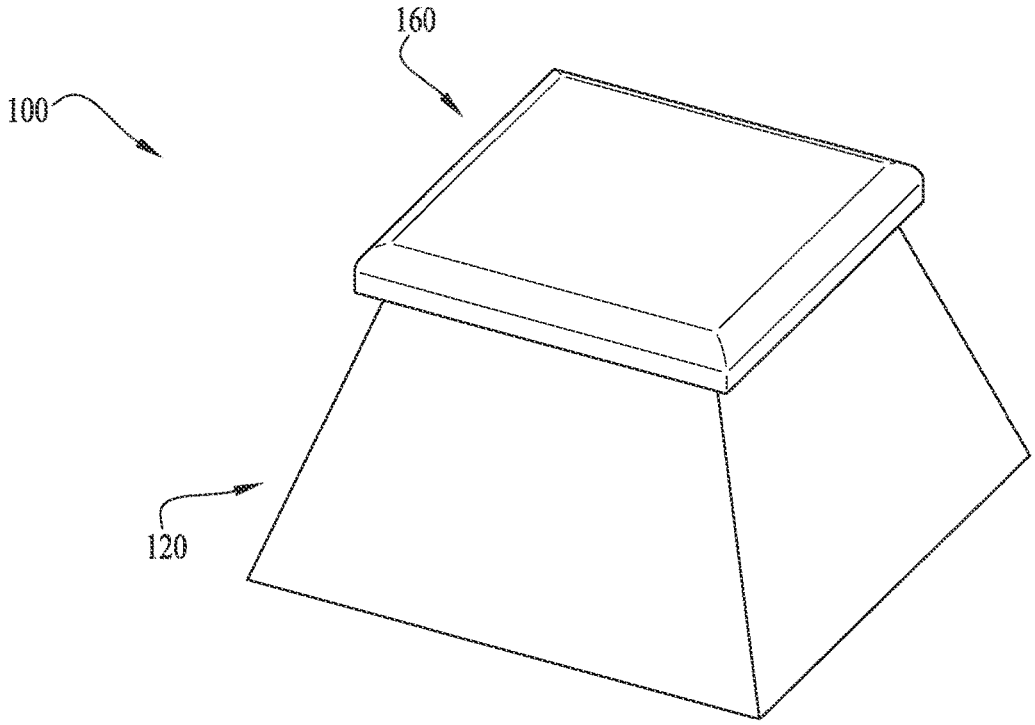
FIG. 7 is a front perspective view of a balance training device according to another example embodiment of the present invention.
Figure 8:
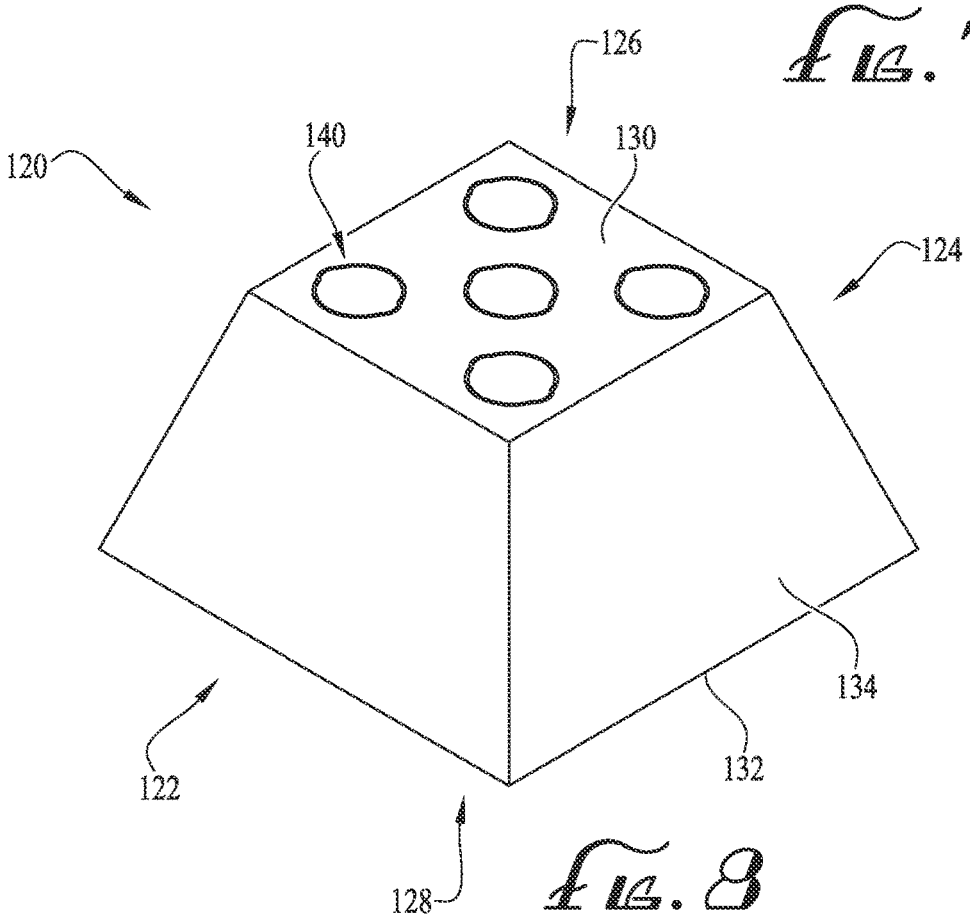
FIG. 8 is a front perspective view of a portion of the balance training device of FIG. 7.
Figure 9:
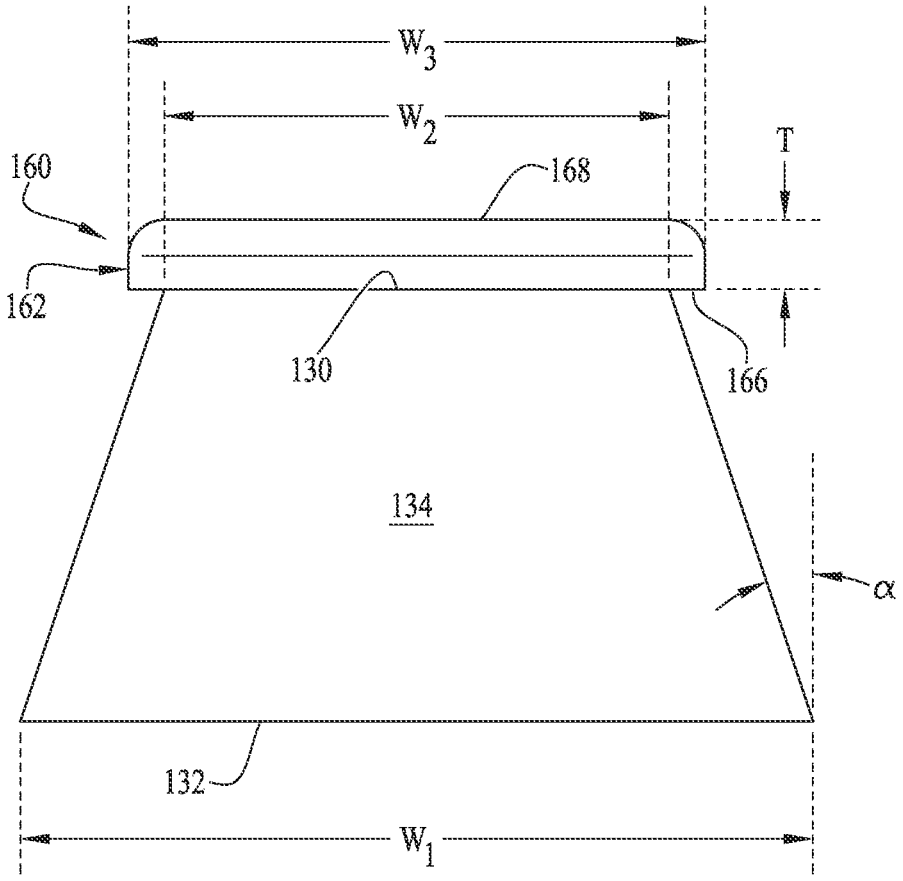
FIG. 9 is a side view of the balance training device of FIG. 7.
Figure 10:
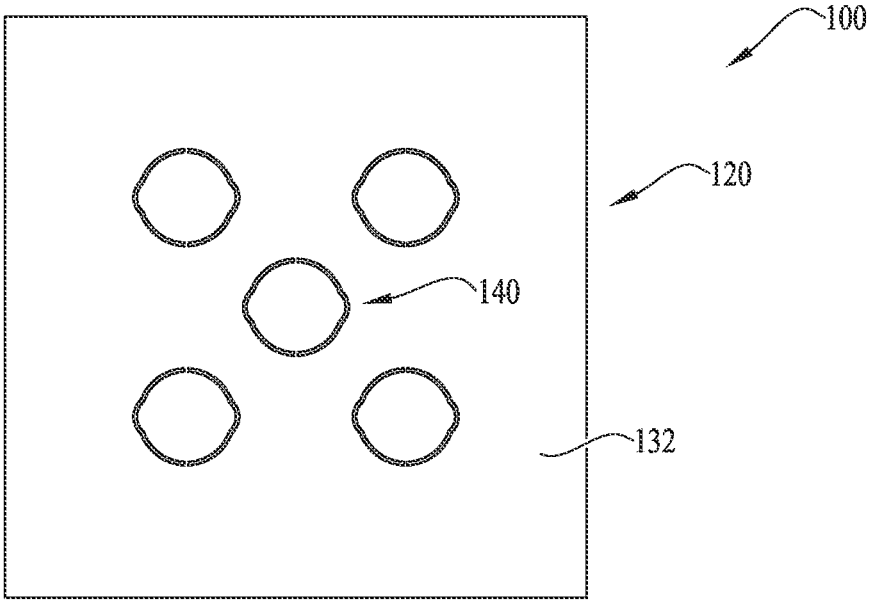
FIG. 10 is a bottom view of the balance training device of FIG. 7.
Figure 11:
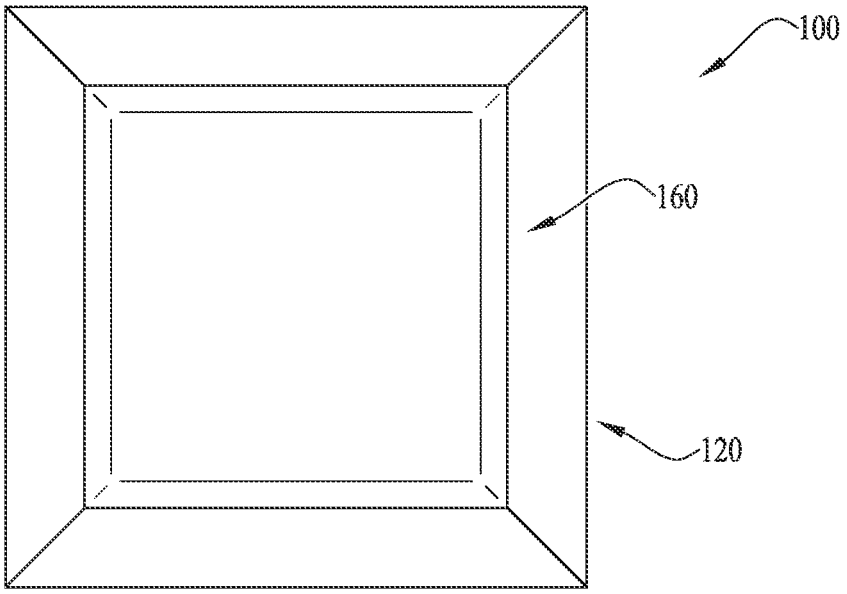
FIG. 11 is a top view of the balance training device of FIG. 7.

Referring to FIGS. 2 and 5 and as briefly described above, the base member 20 comprises one or more adjustability features 40. In example embodiments, the adjustability features 40 allow for adjustment to the stability of the base member 20, for example, so as to allow for the stability of the base member to be varied based on the configuration of the adjustability features 40. For example, the base member 20 becomes more unstable with the removal of one or more portions thereof, for example, such that the level of difficulty increases as portions of the one or more adjustability features 40 are removed from the base member 20. As depicted in FIG. 5A, the adjustability feature 40 comprises a pair of opposing channels 42 that are separated by at least one tab or support portion 44, for example, so as to define a plug member 46 between the opposing channels 42 and which is interconnected with the at least one support portion 44. In example embodiments, the opposing channels 42 extend along a generally C-shaped path, for example, so as to define a cylindrical-like plug that extends from the top surface 30 to the bottom surface 32. Thus, in example embodiments, the opposing channels 42 similarly extend through the entirety of the base member 20, for example, from the upper surface 30 to the lower surface 32. Optionally, only one channel (or multiple channels) extending along a desired path can be provided as desired. According to example embodiments, the channels are formed in the base member 20 by water jet cutting, for example, which generally define a width of about 0.05-0.15 inches in width.

In example embodiments, to remove the plug member 46 from the base member 20, a user's finger or other tool or other component is placed atop the plug member 46 (on either the upper or lower surface 30, 32) and at least some amount of force and/or pressure is applied thereto, for example, so as to cause the at least one support portion 42 to be severed or torn, thereby releasing or disconnecting the plug member 46 from the base member 20. Thereafter, the plug member 46 can be removed therefrom such that a generally cylindrical opening is formed in the base member 20. In example embodiments, the opening extends entirely through the base member 20 between the upper and lower surfaces 30, 32.

Still referring to FIG. 5A, the plug member 46 comprises a pair of opposing outwardly-extending nubs or protrusions 48, for example, which are generally positioned about portions of the plug member 46 as desired. For example, according to example embodiments of the invention, after the plug member 46 has been disconnected and removed from the base member 20, and for example, wherein the plug member 46 is desired to be reinserted in the opening of the adjustability feature 40 (e.g., to lessen the instability thereof), the plug member 46 is reinserted within the opening such that the protrusions are generally oriented about 90 degrees relative to their initial orientation prior to being initially removed therefrom. For example, according to example embodiments, the protrusions of the plug member 46 are configured to frictionally engage portions of a surface defined by the opening, and thus, remain engaged therein while providing support and stability to the base member 20.

According to example embodiments, the plug member defines a diameter D4 of between about 0.5-2 inches, for example between about 0.75-1.25 inches according to some example embodiments. In example embodiments, a diameter D5 is defined between the outermost portions of the protrusions 48, for example, which is between about 0.65-2.15 inches, for example between about 0.90-1.40 inches according to example embodiments. Thus, according to example embodiments, the protrusions 48 generally provide at least about 0.8 inches of interference with the inner surface of the opening of the adjustability feature 40. According to example embodiments, the protrusions 48 preferably provide sufficient interference when reinserted in the opening such that the stability of the base member 20 is substantially similar to the stability of the base member 20 prior to being initially removed therefrom. In other example embodiments, the adjustability features 40 can be configured such that the stability of the base member can be adjustable based upon how the plug member 46 is inserted/positioned within the opening of the adjustability feature 40, and for example, variable interference fit protrusions (at least two protrusions of differing extensions) may be provided for example, so as to provide at least two possible interference fits, and thus, at least two possible variances of the plug member 46 being engaged with the opening of the adjustability feature 40.

As depicted in FIG. 5, the base member 20 comprises about five adjustability features 40. In example embodiments, the adjustability features 40 are generally spaced-apart along an elongate axis that is generally centrally-positioned and extending along the length of the base member 20. According to example embodiments, an adjustability feature 40 is provided at a midpoint of the base member 20, for example, positioned at about ½ the length L of the base member 20, for example to define a distance D1. Outermost adjustability features 40 are positioned at a distance D2 from the ends 22, 24 of the base member, and intermediate adjustability features 40 are positioned at a distance D3 from the outermost adjustability features. According to example embodiments, the distance D2 is generally between about 1-3 inches, for example between about 1.5-2 inches according to example embodiments. And the distance D3 is generally between about 1.5-4 inches, for example, between about 2.5-3 inches according to example embodiments. Preferably, the base member 20 can comprise more or less than five adjustability features 40, and preferably the adjustability features 40 can be positioned and spaced apart as desired.

Thus, according to example embodiments, the base member 20 comprises a unitary, one-piece base member or component comprising initially integral, yet removable and reinsertable adjustability features such that the degree of stability of the base member can be adjusted and varied between a most stable configuration (e.g., all plug members 46 inserted) and a most unstable configuration (e.g., all plug members 46 removed). For example, with each plug member 46 that is removed from its respective adjustability feature 40, the more unstable the base member 20 will be with the application of the same weight (compared to the weight being applied with the plug member(s) reinserted).

According to example embodiments, the adjustability features provide variability to the allowable deformation of the base member 20 between a most stable configuration with the least amount of allowable deformation and a most unstable configuration with the most amount of allowable deformation. Preferably, according to some example embodiments, an intermediate amount of instability may be desired, for example, wherein only a select few plugs are removed.

Optionally, according to other example embodiments, the plug members 46 can be separate components that can be inserted in the openings of the adjustability features 40 as desired. According to some example embodiments, one or more of the plug members 46 can be at least partially formed from one or more materials different than the material of the base member 20.

Figure 12:
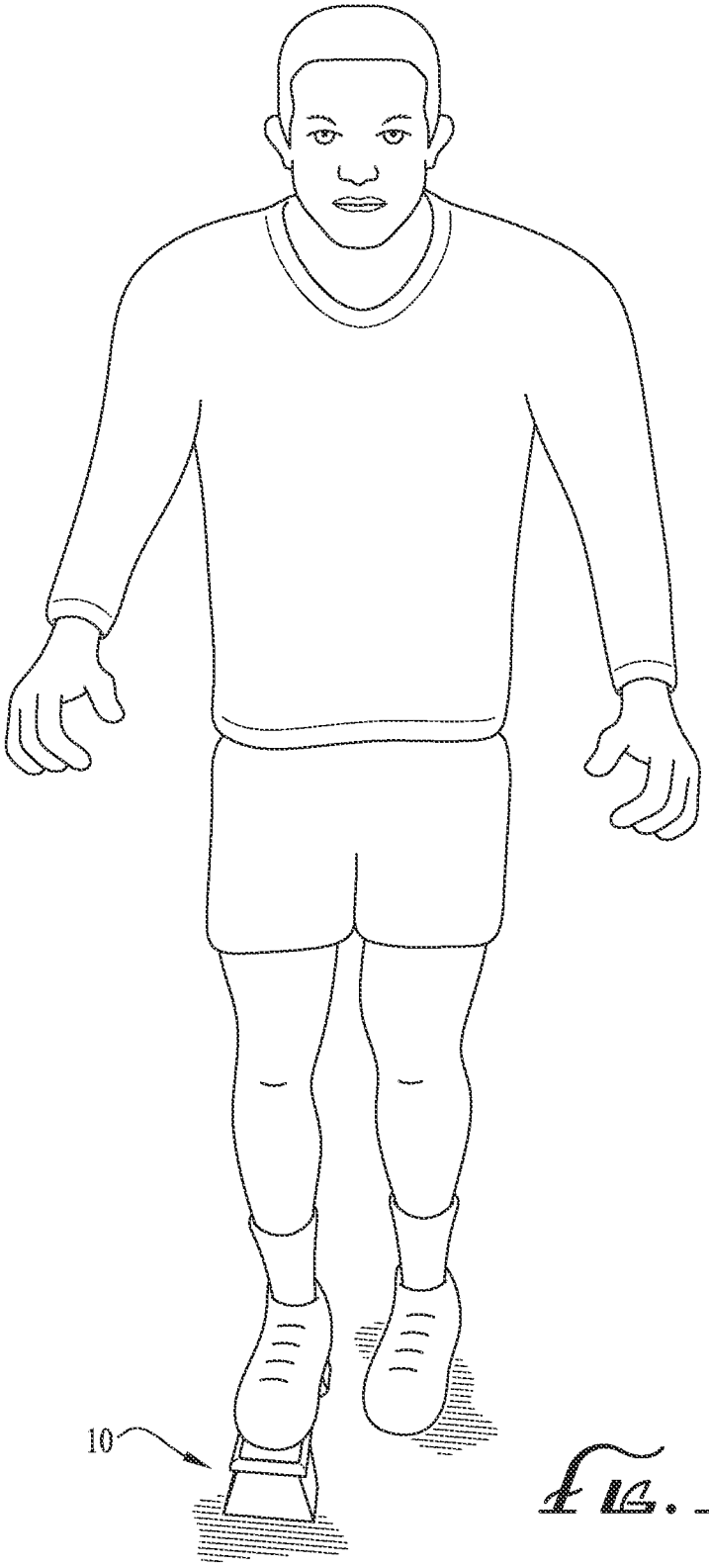
FIG. 12 shows a front perspective view of an athlete balancing on a balance training device according to an example embodiment of the present invention.

Referring back to FIG. 3, the platform 60 is configured to be positioned atop the upper surface 30 of the base member so as to provide a substantially rigid surface for placing a foot thereon to attempt one or more balance challenges. For example, as depicted in FIG. 12, a user, with one foot placed on an upper surface 70 of the platform 60 and the other foot remaining free from engagement therewith or the ground or support surface, attempts to balance thereon. Preferably, as described above, the user can remove one or more of the plug members 46 of the adjustability features 40 so as to increase the instability of the base member 20, and thus, increase the balance challenge.

Referring back to FIGS. 3-4, the platform 60 is generally elongate and extends from a first end 62 to a second end 64, and comprises a lower surface 66 and an upper surface 68. In example embodiments, the plate member comprises a length that is substantially similar to the length L of the base member 20, however, the length of the platform 60 can be sized to be less than or greater than the length L of the base member 20. Further, the platform 60 comprises a width W3 and a thickness T. The width W3 is generally between about 3-6 inches, for example, between about 3.25-4.5 inches according to some example embodiments of the present invention. And the thickness T is generally between about 0.25-0.75 inches, for example between about 0.40-0.60 inches according to some example embodiments of the present invention. Optionally, according to other example embodiments, the width W3 and the thickness T can be sized as desired. According to example embodiments, the platform 60 is sized such that at least the upper surface 68 thereof comprises an area (length×W3) for accommodating at least one foot of a user or athlete. According to some example embodiments, the user may wear a shoe, sock or other component on their foot, for example, which may or may not at least partially extend beyond the bounds of the platform 60. In other example embodiments, the user need not wear any article on their feet such that the foot itself is placed on the upper surface 68 of the platform and the user attempts to balance thereon. According to example embodiments, the platform 60 can be configured to be mounted, coupled or otherwise secured to the base member, for example with hook and loop material or other coupling elements or fasteners.

According to some example embodiments, the platform 60 comprises a 12 mm thick Baltic birch wooden component that is generally rectangular in shape. According to example embodiments, the dimensions of the standing platform can preferably be sized as desired. According to one example embodiment, the plate comprises a width of 3.5 inches, a length of 13 inches and a thickness of 12 millimeters. In another example embodiment, the width is 3.5 inches, the length is 14 inches and the thickness is 12 millimeters. According to another example embodiment, the width is 4 inches, the length is 15 inches and the thickness is 12 millimeters. Optionally, platforms of any desired dimensions, thickness and/or material can be provided as desired. In some example embodiments, an outer periphery edge comprises a 0.25 inch round formed thereon. According to another example embodiment, the upper standing platform can be formed by plastic injection molding, or for example, other forms of molding. According to some example embodiments, the upper surface 68 of the platform 60 can comprise a texturized or rough surface. According to one example embodiment, a layer of grip tape or rubber-like frictional enhancing material 70 can be provided so as to improve the frictional engagement when a foot of a user is applied thereon.

In example embodiments, the base member 20 comprises foam, for example, XLPE (cross-linked polyethylene) or EVA (ethylene-vinyl acetate) foam. According to one example embodiment, the foam comprises a blend, mixture or combination of XLPE and EVA foam. In other example embodiments, the foam can comprise other desired materials or foam compositions, or for example, the foam can comprise a desired amount of deformation per a particular load being applied thereto. According to example embodiments, the foam is closed-cell foam. According to another example embodiment, the foam is open-cell foam. For example, according to some example embodiments, the lower base component can be an inflatable member or a fillable bladder, or for example, can be the type comprising a double-needle construction wherein two or more layers of material are generally connected together by one or more threads, for example, which may be filled with a desired material and/or inflatable or fillable with water, air or another desired material. According to some example embodiments, a fluid-fillable bladder can be incorporated with the base member so as to provide varying levels of instability and adjustability.

According to example embodiments of the present invention, methods of training on a balance device as described in U.S. Pat. No. 9,764,175, for example, comprising multiple balance training protocols comprising orienting the user's foot in various positions relative to an elongate or lengthwise axis of the platform (parallel, perpendicular, 45 degrees) and attempting to balance thereon for a given duration, for example, can similarly be applied to the balance training devices 10, 100 of the present invention. Accordingly and as expressly stated herein, U.S. Pat. No. 9,764,175 is incorporated by reference herein in its entirety for all purposes.

FIGS. 7-11 show a balance training device 100 according to another example embodiment of the present invention. For example, according to example embodiments of the present invention, the balance training device 100 comprises a base member 120 and a platform 160. In example embodiments, the platform 160 can be removably mounted to a top portion of the base member 120, for example, so as to provide an area permitting only a front inside quadrant portion of a user's foot to be placed on the platform 160, for example, such that while all of the user's weight is applied to the platform 160 and through to the base member 120, the user's engagement of the front inside quadrant of their foot (or medial portion, forefoot) with the platform 160 provides key feedback such that the balance of the user's body can correct itself to stay balanced Indeed, rather than a user balancing atop a forgiving or flexible/deformable surface, material or other medium/construction, for example, in either case where all or a portion of the user's foot is directly engaged with an air-filled bladder, foam-only devices, or other deformable "when the user's weight is applied" devices or components, etc., for example, such that the deformable material provides minimal to no feedback to the front inside quadrant portion (or at least the big toe portion thereof); the platforms 60, 160 as described herein preferably provide a surface that can permit engagement of the front inside quadrant of the user's foot including the foot's big toe, and/or one or more toes adjacent the big toe (for example, a front forefoot portion of the foot according to one example embodiment), for example, so as to provide direct and accurate feedback regarding the configuration or particular position and orientation of the platform relative to the unstable base member 20, 120, thereby allowing a user's body to correct itself and maintain balance atop the balance training devices 10, 100 as described herein.

According to example embodiments, the balance training device 100 is generally similar to the balance training device 10 as described above. According to example embodiments of the present invention, the balance training device 100 comprises the base member 120 and a standing platform 160 that is generally centered atop and removably engaged with an upper surface 130 of the base member 120. Similarly, one or more adjustability features 140 can be provided as desired. The base member 120 comprises a generally uniform trapezoidal shape defining a bottom end 128 comprising a lower surface 132 comprising a greater surface area than the surface area defined at a top end 126 comprising an upper surface 130. According to example embodiments, the cross-sectional shape of the base member in either of the axial or lateral directions would result in a trapezoidal shape, or for example, various other polygonal shapes, curves, undulations, etc. as desired. According to example embodiments, the trapezoidal cross section of the base member preferably provides sufficient stabilization to the base member as the user applies the entirety of their weight on the upper surface of the platform and attempts to balance, for example, and prevents "rolling" of the base member even when the platform's orientation and position are rather extreme relative to its natural orientation and position.

According to example embodiments, the bottom width of the base member W1 is between about 3.5-8.5 inches, for example, about 5.5 inches according to one example embodiment. The width of the top end 126 of the base member 120 defines a dimension W2 of between about 2.5-5.5 inches, for example, about 3.5 inches according to one example embodiment. As similarly described above, the platform 160 defines a thickness T of between about 3-6 inches, for example, between about 3.25-4.5 inches, for example, about 4 inches according to some example embodiments. According to example embodiments, the outer stability surfaces 134 of the base member are all generally angled to define an angle $\alpha$ relative to a vertical axis, for example, wherein the angle $\alpha$ is generally between about 10-45 degrees, for example between about 12-35 degrees according to some example embodiments. According to example embodiments, the base member 120 comprises a height H of between about 1.5-5 inches, for example between about 2.5-3.5 inches according to some example embodiments. Optionally, according to alternate example embodiments, the dimensions as noted herein can be varied as desired, for example, up to 70% less than or greater than the minimum and maximum values of the dimensional ranges as described herein. According to one example embodiment, the lower surface of the bottom portion of the base member 20 comprises a generally polygonal footprint, for example a square-shaped footprint according to one example embodiment. According to example embodiments, the footprint comprises four equal sides and vertex angles, for example, wherein each side defines a dimension of W1, for example, between about 3.5-8.5 inches according to example embodiments.

According to one example embodiment, the lower surface of the bottom portion of the base member 20 comprises an I-shaped footprint, the I-shaped footprint defining an outer profile comprising a centrally-located narrowed portion and outwardly-located widened portions, the centrally-located narrowed portion comprising a central side-to-side dimension substantially similar to the second width W2, and wherein the outwardly-located widened portions define an outer side-to-side dimension that is substantially similar to the first width W1.

According to example embodiments, two or more balance training devices can be spaced apart in a random pattern or array, for example, wherein a user/athlete must move throughout a set of defined steps or moves from one device to the next, without touching the ground and thus remaining balanced on the platform of one of the devices at a time. According to example embodiments, it is the front inside quadrant of the user's foot that is ultimately engaging with the platform of each of the devices as the user moves throughout one or more spaced-apart balance devices 100. According to one example embodiment, the devices 100 are generally spaced between about 6-36 inches from each other, for example, and the user moves from one device 100 to another device 100 in a desired configuration or quantity, etc.

While the invention has been described with reference to preferred and example embodiments, it will be understood by those skilled in the art that a variety of modifications, additions and deletions are within the scope of the invention, as defined by the following claims.

What is claimed is:

1. A balance training aid comprising an upper standing platform and a lower base component, the upper standing platform configured for placement atop the lower base component and configured to receive at least a portion of a user's foot thereon, the lower base component being generally elongate and extending along a length between first and second ends and comprising at least one adjustability feature connected therewith for providing variability to the unstableness of the balance training aid, the lower base component further comprising a top portion defining an upper surface and a bottom portion defining a lower surface, and comprising outwardly opposing side surfaces extending between the upper and lower surfaces along the length thereof, each of the side surfaces comprising a central surface, outer stability surfaces, and transitional surfaces extending between the outer stability surfaces and the central surfaces, wherein at least a portion of each of the transitional surfaces is non-linear or curved to provide a continuous and gradual transition between the outer stability surfaces and the central surfaces.

2. The balance training aid of claim 1, wherein the stability surfaces define an angle of between about 12-35 degrees relative to a vertical axis.

3. The balance training aid of claim 1, wherein the first and second ends of the lower base component comprise a polygonal cross-sectional shape defining the upper and lower surfaces and a pair of stability surfaces, and wherein the polygonal cross-sectional shape is trapezoidal.

4. The balance training aid of claim 1, wherein the at least one adjustability feature comprises a removable and reinsertable plug member.

5. The balance training aid of claim 4, wherein the lower base comprises two or more removable and reinsertable plug members.

6. The balance training aid of claim 4, wherein the plug member is generally elongate comprising a length and being generally cylindrical in cross section, and wherein one or more outwardly-extending protrusions extend from an outer periphery of the plug member along at least a portion of its length.

7. The balance training aid of claim 1, wherein the platform comprises a length of between about 8-20 inches, a width of between about 3-6 inches, and a thickness of between about 0.25-0.75 inches.

8. The balance training aid of claim 1, wherein the lower base component defines a length of between about 8-20 inches between the first and second ends thereof, a height of between about 1.5-5 inches defined between the upper and lower surfaces, a first width of between about 3.5-7 inches defined at the lower surface and a second width of between about 2-5 inches defined at the upper surface.

9. The balance training aid of claim 8, wherein the length is between about 12.50-14.88 inches, the height is between about 2.5-3.5 inches, the first width is between about 4.69-5.50 inches, and the second width is between about 3-3.5 inches.

10. The balance training aid of claim 1, wherein the lower surface comprises an I-shaped footprint, the I-shaped footprint defining an outer profile comprising a centrally-located narrowed portion and outwardly-located widened portions, the centrally-located narrowed portion comprising a central side-to-side dimension of between about 2-5 inches, and wherein the outwardly-located widened portions define an outer side-to-side dimension of between about 3.5-7 inches.

11. The balance training aid of claim 1, wherein the lower base component comprises a foam material comprising cross-linked polyethylene, ethylene-vinyl acetate, or a combination thereof.

12. A balance training device comprising:

an upper standing platform; and a base member, the base member comprising a unitary, one-piece component comprising at least one adjustability feature connected therewith to provide variability to the allowable deformation thereof between a most stable configuration with the least amount of allowable deformation and a most unstable configuration with the most amount of allowable deformation, the at least one adjustability feature being initially integral with the base member, the at least one adjustability feature being removable from the base member, and the at least one adjustability feature being reattachable with the base member.

13. The balance training device of claim 12, wherein the at least one adjustability feature comprises a generally elongate plug member fitted within a channel that is defined within at least a portion of the base member, the plug member being initially integral with the base member, the plug member being removable from the channel of the base member, and the plug member being reinsertable within the channel.

14. The balance training device of claim 12, wherein the base member comprises a length, a height, an upper surface and opposite lower surface.

15. The balance training device of claim 14, wherein the lower surface defines a footprint and is configured for resting atop a surface, the footprint defining a polygonal shape.

16. The balance training device of claim 14, wherein the lower surface defines a footprint and is configured for resting atop a surface, the footprint being generally I-shaped defining an outer profile comprising a centrally-located narrowed portion, outwardly-located widened portions, and transitional portions connected between the centrally-located narrowed portion and the outwardly-located widened portions, the transitional portions providing a continuous transition of the outer profile between the centrally-located narrowed portion and the outwardly-located widened portions.

17. The balance training device of claim 14, wherein the base member comprises a polygonal cross-sectional shape when taken along its length.

18. A balance device comprising a lower base component and an upper standing platform configured for placement atop the lower base component, the lower base component comprising an unstable or deformable material and the platform comprising a generally rigid material, the lower base component comprising a length, a height, an upper surface and a lower surface, the lower surface defining a footprint comprising a centrally-located narrowed portion and outwardly-located widened portions, and wherein generally non-linear transitional portions are defined along the footprint between the outwardly-located widened portions and the centrally-located narrowed portion, the balance device further comprising at least one adjustability feature integrally formed with the base, the at least one adjustability feature providing variability to the allowable deformation thereof between a most stable configuration with the least amount of allowable deformation and a most unstable configuration with the most amount of allowable deformation.

19. The balance device of claim 18, wherein the at least one adjustability feature is optionally removable to provide the most amount of allowable deformation, and wherein maintaining the at least one adjustability feature with the base causes the balance device to remain in the most stable configuration with the least amount of allowable deformation.

* * * * *